US011819176B2

(12) United States Patent
Lee et al.

(10) Patent No.: US 11,819,176 B2
(45) Date of Patent: Nov. 21, 2023

(54) DISHWASHER

(71) Applicant: Samsung Electronics Co., Ltd., Suwon-si (KR)

(72) Inventors: Changwook Lee, Suwon-si (KR); Minho Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 253 days.

(21) Appl. No.: 17/248,869

(22) Filed: Feb. 11, 2021

(65) Prior Publication Data

US 2021/0244256 A1 Aug. 12, 2021

(30) Foreign Application Priority Data

Feb. 12, 2020 (KR) ..... 10-2020-0016775

(51) Int. Cl.
*A47L 15/22* (2006.01)
*A47L 15/42* (2006.01)
*A47L 15/50* (2006.01)

(52) U.S. Cl.
CPC ..... *A47L 15/4221* (2013.01); *A47L 15/22* (2013.01); *A47L 15/428* (2013.01); *A47L 15/4214* (2013.01); *A47L 15/4217* (2013.01); *A47L 15/4219* (2013.01); *A47L 15/4282* (2013.01); *A47L 15/504* (2013.01); *A47L 15/508* (2013.01)

(58) Field of Classification Search
CPC .. A47L 15/22; A47L 15/4214; A47L 15/4217; A47L 15/4219; A47L 15/4221; A47L 15/428; A47L 15/4282; A47L 15/504; A47L 15/508
USPC ..... 134/56 D, 57 D, 58 D, 178
See application file for complete search history.

(56) References Cited

U.S. PATENT DOCUMENTS

| | | | |
|---|---|---|---|
| 9,801,523 | B2 | 10/2017 | Thiyagarajan |
| 10,463,227 | B2 | 11/2019 | Beshears, Jr. et al. |
| 10,531,781 | B2 | 1/2020 | Digman et al. |
| 2007/0235063 | A1 | 10/2007 | Lee et al. |
| 2012/0285491 | A1 | 11/2012 | Blanchard et al. |
| 2012/0291827 | A1 | 11/2012 | Buddharaju et al. |

(Continued)

FOREIGN PATENT DOCUMENTS

| | | | |
|---|---|---|---|
| CN | 204909344 | U | 12/2015 |
| DE | 10 2015 103128 | A1 | 9/2015 |

(Continued)

OTHER PUBLICATIONS

International Search Report of the International Searching Authority dated May 7, 2021 in connection with International Application No. PCT/KR2021/001704, 4 pages.

(Continued)

*Primary Examiner* — Levon J Shahinian

(57) ABSTRACT

Provided is a dishwasher having an improved structure capable of selecting whether to spray wash water. The dishwasher includes a washing tub, a basket provided in the washing tub to accommodate dishware, a duct provided in the washing tub to be supplied with wash water, a sub-duct mounted on the basket to guide the wash water, a connection pipe connected to the sub-duct, and a spray nozzle coupled to the connection pipe to be rotatable from a first position where the connection pipe is open and a second position where the connection pipe is closed.

20 Claims, 12 Drawing Sheets

(56) References Cited

U.S. PATENT DOCUMENTS

| | | | | |
|---|---|---|---|---|
| 2013/0255733 | A1* | 10/2013 | Ju | A47L 15/23 134/179 |
| 2014/0216507 | A1 | 8/2014 | Pyo | |
| 2016/0302643 | A1 | 10/2016 | Mersch | |
| 2018/0168428 | A1 | 6/2018 | Wilson et al. | |
| 2019/0099054 | A1 | 4/2019 | Digman et al. | |

FOREIGN PATENT DOCUMENTS

| | | | |
|---|---|---|---|
| JP | 2004-305583 | A | 11/2004 |
| JP | 2005-328886 | A | 12/2005 |
| JP | 2011-050782 | A | 3/2011 |
| KR | 20-1993-0002168 | Y1 | 11/1993 |
| KR | 20-1998-0022724 | U | 7/1998 |
| KR | 20-0122265 | Y1 | 8/1998 |
| KR | 10-1999-0070295 | A | 9/1999 |
| KR | 10-2007-0100554 | A | 10/2007 |
| KR | 10-2008-0088123 | A | 10/2008 |
| KR | 10-2010-0128545 | A | 12/2010 |
| KR | 10-1052779 | B1 | 7/2011 |
| KR | 10-1137786 | B1 | 4/2012 |
| KR | 10-2013-0110867 | A | 10/2013 |
| KR | 10-2014-0037553 | A | 3/2014 |
| KR | 10-2016-0040075 | A | 4/2016 |
| KR | 10-1890623 | B1 | 8/2018 |
| WO | 2019/223966 | A1 | 11/2019 |

OTHER PUBLICATIONS

Supplementary European Search Report dated Sep. 14, 2022 in connection with European Patent Application No. 21 75 4015, 9 pages.

* cited by examiner

DISHWASHER

CROSS-REFERENCE TO RELATED APPLICATION

This application is based on and claims priority under 35 U.S.C. § 119 to Korean Patent Application No. 10-2020-0016775, filed on Feb. 12, 2020, in the Korean Intellectual Property Office, the disclosure of which is incorporated herein by reference.

BACKGROUND

1. Field

The disclosure relates to a dishwasher having an improved structure capable of selecting whether to spray wash water.

2. Description of the Related Art

In general, a dishwasher refers to a device for cleaning dishware stored therein by spraying wash water at a high pressure and drying the dishware. In detail, the dishwasher operates by spraying wash water at a high pressure into a washing tub in which the dishware is stored, to cause, by the sprayed wash water coming into contact with the dishware, foreign substances, such as food scraps, on the surface of the dishware to be washed.

The dishwasher includes a main body, a washing tub provided inside the main body to form a space for washing dishware, a door located at a front of the washing tub to open and close the washing tub, a sump unit provided at a lower portion of the washing tub to supply, collect, circulate, and drain the wash water, and a spray unit for spraying wash water into the washing tub. In addition, the dishwasher is provided with a basket in the washing tub to be pulled in or out such that dishware is placed on the basket.

Dishware having a great depth may not be washed clean by wash water sprayed from a general spray unit. Accordingly, a separate spray nozzle may be mounted at one side of the basket to wash dishware having a great depth.

SUMMARY

Therefore, it is an object of the disclosure to provide a dishwasher capable of selecting whether to spray wash water through a spray nozzle with a simple structure.

It is another object of the disclosure to provide a dishwasher having an improved structure so that wash water is supplied to a spray nozzle regardless of a change in height of a basket.

Additional aspects of the disclosure will be set forth in part in the description which follows and, in part, will be obvious from the description, or may be learned by practice of the disclosure.

In accordance with one aspect of the disclosure, there is provided a dishwasher including: a washing tub; a basket provided in the washing tub to accommodate dishware; a duct provided in the washing tub to be supplied with wash water; a sub-duct mounted on the basket to guide the wash water; a connection pipe including a flow path connected to the sub-duct; and a spray nozzle coupled to the connection pipe to be rotatable from a first position where the connection pipe is open and a second position where the connection pipe is closed.

The connection pipe may include: a baffle provided to block a part of the flow path of the connection pipe; and an opening portion formed next to the baffle in a rotation direction of the spray nozzle.

The baffle and the opening portion may form a first baffle and a first opening portion, respectively, and the spray nozzle may include a second baffle provided to cover the opening portion of the connection pipe when the spray nozzle is in the second position and a second opening formed next to the second baffle in the rotation direction of the spray nozzle.

When the spray nozzle is rotated from the second position to the first position to cause the second baffle to come in contact with an upper surface of the first baffle, wash water may be sprayed to an inside of the washing tub through the first opening portion and the second opening portion.

When the spray nozzle is rotated from the first position to the second position to cause the second baffle to cover the first opening portion, the wash water may be prevented from being sprayed into the washing tub.

The connection pipe may include a first protrusion protruding outward, and the spray nozzle may include a first groove portion formed as a cut continuously formed along a rotation direction and a rotation axis direction of the spray nozzle to accommodate the first protrusion to thereby be detachably coupled to the connection pipe.

The first groove portion may be formed with a locking protrusion to interfere with rotation of the first protrusion.

The spray nozzle may include a guide pipe coupled to the connection pipe to guide a flow of the wash water; and a nozzle portion detachably coupled to the guide pipe to spray the wash water into the washing tub.

The nozzle portion may include: a body fitted to an inner surface of the guide pipe; and a spray guide portion configured to guide a spray direction such that the wash water is sprayed in a spiral shape.

The body of the nozzle portion may include a second protrusion protruding outward, and the guide pipe may include a second groove portion formed as a cut continuously formed along a rotation direction and a rotation axis direction of the spray nozzle to accommodate the second protrusion.

The second protrusion of the nozzle portion may protrude radially outside of the guide pipe to be accessible from an outside.

The dishwasher may further include: a spray unit mounted at a lower portion of the basket and configured to spray the wash water into the washing tub; and a main duct configured to supply the wash water to the spray unit.

The duct may be integrally formed with the main duct and branched from the main duct.

The dishwasher may further include a height adjusting device coupled to the duct and the sub-duct such that the wash water flows from an outlet portion of the duct to an inlet portion of the sub-duct based on a change in a height of the basket.

The height adjusting device may include: a first housing including a plurality of openings into which the outlet portion of the duct is inserted; a second housing coupled to the first housing and connected to the inlet portion of the sub-duct; and a blocking member coupled to an inside of the first housing and provided to selectively close one of the plurality of openings according to the insertion of the outlet portion of the duct In accordance with another aspect of the disclosure, there is provided a dishwasher including: a washing tub; a basket provided in the washing tub to accommodate dishware; a duct provided in the washing tub to be supplied with wash water; a sub-duct mounted on the basket to guide the wash water; a connection pipe communicating with the sub-duct to form a flow path; a spray nozzle detachably coupled to the connection pipe; a valve member configured to close the flow path provided between the sub-duct and the connection pipe; and a rod provided in the spray nozzle and configured to press the valve member to open the flow path when the spray nozzle is mounted to the connection pipe.

The valve member may include a material having elasticity, and configured to cause the flow path to be closed by an elastic restoring force without the spray nozzle being mounted on the connection pipe, The rod may be configured to be extended into the connection pipe from an inside of the spray nozzle to cause the valve member to be pressed when the spray nozzle is mounted to the connection pipe.

In accordance with another aspect of the disclosure, there is provided a dishwasher including: a washing tub; a basket provided to accommodate dishware; a duct provided in the washing tub to be supplied with wash water; a sub-duct mounted on the basket to guide the wash water; a connection pipe formed to extend upward from the sub-duct; and a spray nozzle provided to be movable relative to the connection pipe, the spray nozzle configured to open and close the connection pipe based on a change of a position of the spray nozzle.

The dishwasher may further include: a height adjusting device configured to connect the duct to the sub-duct based on a height of the basket, wherein the height adjusting device includes: a first housing including a plurality of openings into which an outlet portion of the duct is inserted; a second housing coupled to the first housing and connected to an inlet portion of the sub-duct; and a blocking member coupled to an inside of the first housing and configured to selectively close one of the plurality of openings according to the insertion of the outlet portion of the duct.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
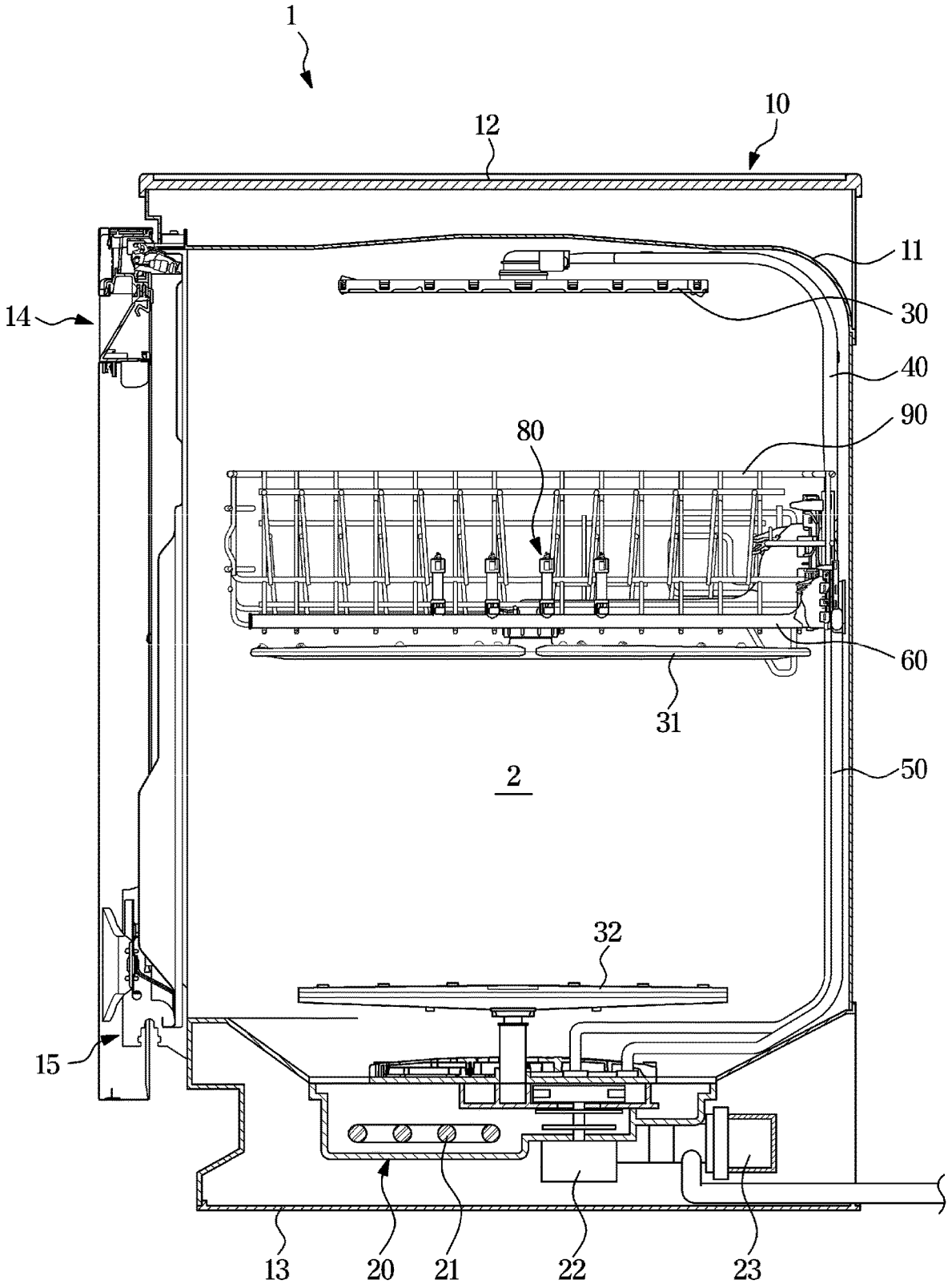
FIG. 1 is a schematic diagram illustrating a dishwasher according to the first embodiment of the disclosure.

FIGS. 1 through 12, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The embodiments set forth herein and illustrated in the configuration of the disclosure are only the most preferred embodiments and are not representative of the full technical spirit of the disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

Hereinafter, embodiments according to the disclosure will be described in detail with reference to the accompanying drawings.

FIG. 1 is a schematic diagram illustrating a dishwasher according to the first embodiment of the disclosure.

Referring to FIG. 1, a dishwasher 1 includes a cabinet 10 forming the external appearance, a washing tub 11 disposed inside the cabinet 10 and forming a washing chamber 2, and a door 14 installed on the cabinet 10 to open and close the washing tub 11.

The cabinet 10 and the washing tub 11 are each provided in the form of a hexahedron with one side thereof openable. The cabinet 10 may be provided at a lower side thereof with a base 13 and at an upper side thereof with a top cover 12.

The door 14 may be rotatably installed on the cabinet 10. In detail, the door 14 may be rotatably hinged to a lower end of the cabinet 10. The door 14 may be coupled to the cabinet 10 by a hinge device 15. However, the position of the hinge device 15 is not limited thereto.

The cabinet 10 may have a sump unit 20 provided at a lower portion of the washing tub 11 in the cabinet 10 to collect water to be used for washing. The sump unit 20 may be disposed at the center of the bottom of the washing tub 11 to collect wash water used for washing.

The dishwasher 1 may include a main duct 40 and a duct 50 provided in the washing tub 11 to be supplied with wash water from the sump unit 20.

The sump unit 20 may include a washing pump 22 that pumps stored water into the main duct 40 and the duct 50. The wash water pumped by the washing pump 22 may be supplied through the main duct 40 to a plurality of spray units and may be supplied through the duct 50 to a sub-duct 60, which will be described below.

The dishwasher 1 may include a heater 21 disposed below the washing tub 11 to heat the wash water and a drain pump 23 disposed below the washing tub 11 to drain the wash water.

The dishwasher 1 may include a basket 90 provided in the washing tub 11 to accommodate dishware, and a plurality of spray units for spraying wash water supplied from the sump unit 20 toward the dishware contained in the basket 90. In the embodiment shown in FIG. 1, only one basket 90 is illustrated, but the disclosure is not limited thereto, and a plurality of baskets 90 may be provided.

The plurality of spray units may include a first spray unit 30 disposed at an upper side of the washing tub 11, a second spray unit 31 mounted on a lower portion of the basket 90 between the first spray unit 30 and a third spray unit 32, and the third spray unit 32 disposed at a lower side of the washing tub 11. The plurality of spray units are provided to be rotatable. In particular, the second spray unit 31 may be mounted on the lower portion of the basket 90 to spray the wash water into the washing tub 11.

The dishwasher 1 may include the sub-duct 60. The sub-duct 60 may be mounted on the basket 90 to guide the wash water supplied from the duct 50.

The dishwasher 1 may include a connection pipe 70 extending upward from the sub-duct 60 and a spray nozzle 80 coupled to the connection pipe 70. Details thereof will be described below.

Figure 2:
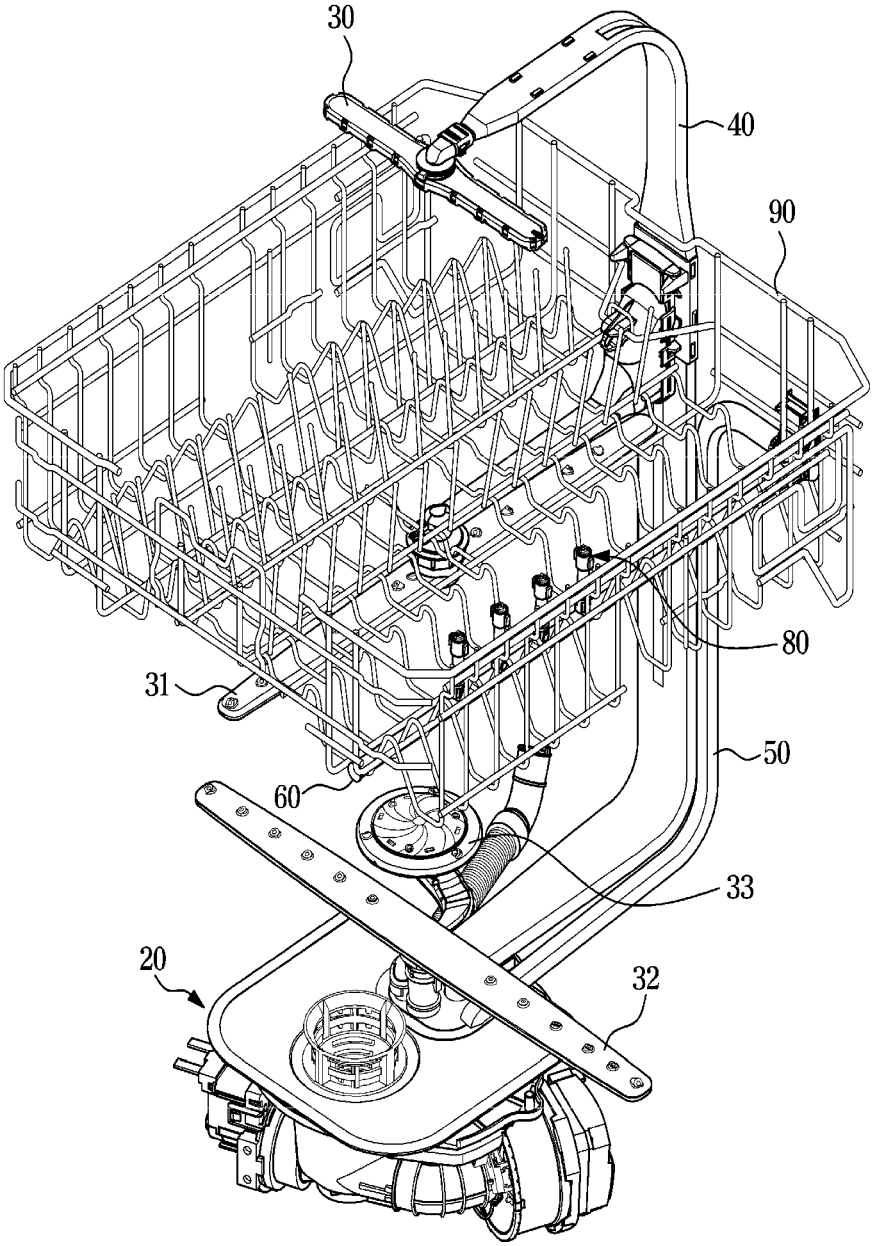
FIG. 2 is a perspective view illustrating main parts of the dishwasher according to the first embodiment of the disclosure.

FIG. 2 is a perspective view illustrating main parts of the dishwasher according to the first embodiment of the disclosure.

Referring to FIG. 2, the dishwasher 1 may include the sump unit 20 that collects wash water used for washing. The sump unit 20 may supply the collected wash water to the plurality of spray units through the main duct 40, and may supply the collected wash water to the sub-duct 60 and the spray nozzle 80 through the duct 50.

In the embodiment shown in FIG. 2, the main duct 40 and the duct 50 are illustrated as being provided separately from each other so as to individually receive the wash water from the sump unit. However, as will be described below, the duct 50 may be formed to be branched from the middle of the main duct 40. This will be described in detail in the description of FIG. 12.

The dishwasher 1 may include an auxiliary spray unit 33. The auxiliary spray unit 33 is disposed at one side of a lower portion of the washing chamber 2 to spray the wash water in a partial area. The auxiliary spray unit 33 is designed to spray water at a relatively high pressure compared to other spray units so that dishware with severe contamination may be intensively washed.

The sub-duct 60 may be connected to at least one spray nozzle 80. The spray nozzle 80 may be provided to, when dishware having a deep depth are accommodated in the dishwasher 1, to effectively clean the inside of the dishware. The sub-duct 60 may be mounted at one side of the basket 90 to receive wash water from the duct 50. However, the position of the sub-duct 60 is not limited thereto.

Figure 3:
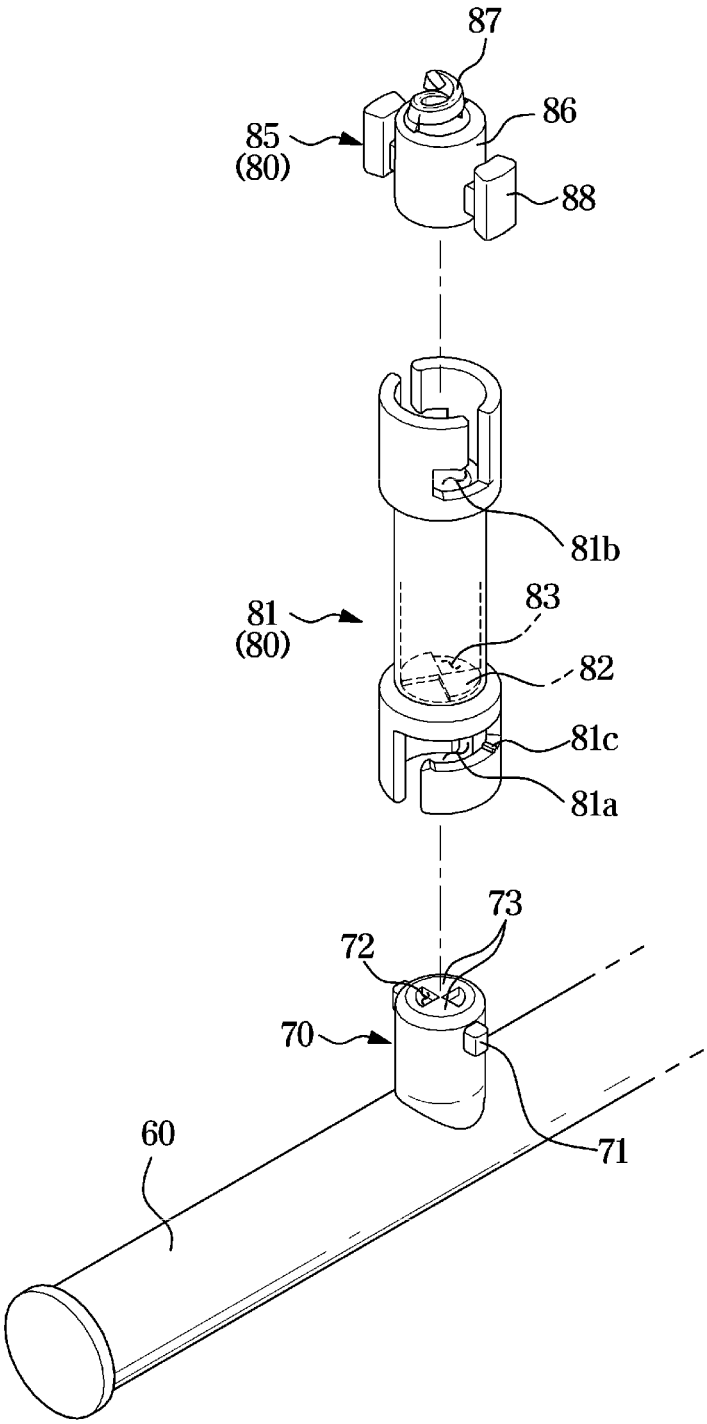
FIG. 3 is a perspective view illustrating a sub-duct, a connection pipe, and a spray nozzle of the dishwasher according to the first embodiment of the disclosure.

FIG. 3 is a perspective view illustrating a sub-duct, a connection pipe, and a spray nozzle of the dishwasher according to the first embodiment of the disclosure.

Referring to FIG. 3, the dishwasher 1 may include the sub-duct 60 and the connection pipe 70.

The connection pipe 70 may be connected to the sub-duct 60. The connection pipe 70 may be formed to extend upward from the sub-duct 60. The connection pipe 70 may be integrally formed with the sub-duct 60. However, the implementation of the connection pipe 70 is not limited thereto and the connection pipe 70 may be provided as a separate configuration. The connection pipe 70 may be provided in at least one unit thereof.

The connection pipe 70 may include a first baffle 73 and a first opening portion 72.

The first baffle 73 of the connection pipe 70 may be provided to interfere with the flow of wash water in the connection pipe 70. In other words, the first baffle 73 may be provided to block a part of a flow path. The first baffle 73 may be provided substantially perpendicular to the flow direction of the wash water. In the embodiment shown in FIG. 3, the first baffle 73 is illustrated as being provided as a pair of first baffles 73 that face each other. However, the disclosure is not limited thereto, and the first baffle 73 may be provided as one unit, or a pair or more units thereof.

The first opening portion 72 of the connection pipe 70 may be provided to allow the wash water to pass therethrough to a side of the first baffle 73. The first opening portion 72 may be formed next to the first baffle 73 in the rotation direction of the spray nozzle 80. The first opening portion 72 may be provided to be open. Details of the flow of wash water through the first baffle 73 and the first opening portion 72 will be described below.

The connection pipe 70 may include a first protrusion 71 protruding outward. The first protrusion 71 may be accommodated and fixed in a first groove portion 81*a* of the spray nozzle 80 to be described below. With such a configuration, the coupling of the connection pipe 70 and the spray nozzle 80 may be firmly maintained.

The dishwasher 1 may include the spray nozzle 80 that is coupled to the connection pipe 70. In detail, the spray nozzle 80 may be provided to be rotatable relative to the connection pipe 70. The spray nozzle 80 may be provided in at least one unit thereof corresponding in number to the number of the connection pipes 70.

The spray nozzle 80 may include a guide pipe 81 and a nozzle portion 85. The guide pipe 81 may be detachably coupled to the connection pipe 70. In addition, the nozzle portion 85 may be detachably coupled to the guide pipe 81. In detail, the connection pipe 70 may be coupled to one side of the guide pipe 81 and the nozzle portion 85 may be coupled to the other side of the guide pipe 81.

The guide pipe 81 may include a first groove portion 81*a* and a second groove portion 81*b*. The first groove portion 81*a* of the guide pipe 81 may be formed at the one side of the guide pipe 81. Accordingly, the first protrusion 71 of the connection pipe 70 may be accommodated and fixed in the first groove portion 81*a*.

The first groove portion 81*a* may be formed as a cut continuously formed along the rotation direction and the rotation axis direction of the spray nozzle 80 so as to receive the first protrusion 71 to thereby be detachably coupled to the connection pipe 70.

The first groove portion 81*a* may be provided to be approximately "¬" shaped. In addition, a locking protrusion 81*c* may be formed in the first groove portion 81*a* to interfere with rotation of the first protrusion 71. The locking protrusion 81*c* may be formed to extend upward. Accordingly, arbitrary rotation of the first protrusion 71 may be prevented.

With such a configuration, the connection pipe 70 may be coupled to the one side of the guide pipe 81.

In addition, the second groove portion 81*b* of the guide pipe 81 may be formed at the other side of the guide pipe 81. A second protrusion 88 of the nozzle portion 85 to be described below may be accommodated and fixed in the second groove portion 81*b* of the guide pipe 81.

The second groove portion 81*b* may be formed as a cut continuously formed along the rotation direction and the rotation axis direction of the spray nozzle 80 so as to receive the second protrusion 88 to thereby be detachably coupled to the connection pipe 70. The second groove portion 81*b* may be provided to be approximately "¬" shaped.

Therefore, the guide pipe 81 may be coupled to the connection pipe 70 to guide the flow of the wash water. In addition, the nozzle portion 85 may be coupled to the guide pipe 81 to spray wash water into the washing tub 11. The wash water may flow through the sub-duct 60, the connection pipe 70, the guide pipe 81, and the nozzle portion 85. That is, the sub-duct 60, the connection pipe 70, the guide pipe 81, and the nozzle portion 85 may form a flow path through which wash water flows.

The nozzle portion 85 may include a body 86 and a spray guide portion 87. The body 86 may be fitted to the inner surface of the guide pipe 81. The spray guide portion 87 may be formed to extend upward in a spiral form from the body 86. With such a configuration, the wash water is sprayed in a spiral manner, so that the washing power is increased.

In addition, the body 86 may include the second protrusion 88 protruding outward. The second protrusion 88 may be accommodated and fixed in the second groove portion 81*b* of the guide pipe 81.

The second protrusion 88 of the body 86 may protrude radially outside of the guide pipe 81, which allows an access to the second protrusion 88 from the outside. Accordingly, the user may grip the second protrusion 88 to separate or install the guide pipe 81 and the nozzle portion 85.

In addition, the spray nozzle 80 may include a second baffle 82 and a second opening portion 83.

As will be described below, the spray nozzle 80 may be rotatable between the first position and the second position. In the first position, the second baffle 82 may come in contact with the upper surface of the first baffle 73. In the second position, the second baffle 82 may be provided to cover the first opening portion 72. That is, the spray nozzle 80 may include the second baffle 82 provided to come in contact with at least a portion of the first baffle 73 of the connection pipe 70. In detail, the second baffle 82 may be formed in the guide pipe 81 of the spray nozzle 80.

The second baffle 82 of the spray nozzle 80 may be provided to interfere with the flow of wash water in the spray nozzle 80. In other words, the second baffle 82 may be provided to block a part of the flow path. The second baffle 82 may be provided substantially perpendicular to the flow direction of the wash water. In the embodiment shown in FIG. 2, the second baffle 82 is illustrated as a pair of second baffles that face each other. However, the disclosure is not limited thereto, and the second baffle 82 may be provided as one unit, or a pair or more units thereof.

The second baffle 82 may be provided in a shape corresponding to the first opening portion 72 of the connection pipe 70. However, the disclosure is not limited thereto, and the second baffle 82 may be provided to have an area larger than that of the first opening portion 72 without limitation as long as it can close the first opening portion 72.

The second opening portion 83 of the spray nozzle 80 may be provided to allow the wash water to pass through a side of the second baffle 82. The second opening portion 83 may be formed next to the second baffle 82 in the rotation direction of the spray nozzle 80. The second opening portion 83 may be provided to be open.

Hereinafter, a process of spray of wash water being determined through rotation of the nozzle portion 185 will be described.

The spray nozzle 80 may be coupled to the connection pipe 70 to be rotatable between the first position in which the connection pipe 70 is open and the second position in which the connection pipe 70 is closed.

In detail, the first position is a position in which the second baffle 82 of the spray nozzle 80 comes in contact with the upper surface of the first baffle 73 of the connection pipe 70. Having the second baffle 82 come in contact with the upper surface of the first baffle 73 represents that the second opening portion 83 and the first opening portion 72 communicate with each other. With such a configuration, wash water may flow through the first opening portion 72 and the second opening portion 83. As a result, wash water may flow through the connection pipe 70 to the spray nozzle 80. That is, the wash water flowing through the spray nozzle 80 may be sprayed into the washing tub 11.

The second position is a position in which the second baffle 82 of the spray nozzle 80 blocks the first opening portion 72 of the connection pipe 70. In other words, the second position is a position in which the first baffle 73 of the connection pipe 70 blocks the second opening portion 83 of the spray nozzle 80, that is, a position to block a flow path through which the wash water flows. With such a configuration, the wash water may not flow through the first opening portion 72 and the second opening portion 83. That is, the flow path through which the wash water flows may be closed. The wash water may not be moved from the connection pipe 70 to the spray nozzle 80 without being sprayed into the washing tub 11.

The user may rotate the spray nozzle 80 between the first position and the second position. Since the spray nozzle 80 may be provided in at least one unit thereof corresponding in number to the connection pipes 70, the user may allow the spray nozzle 80, which is not in use, to be locked and only the spray nozzle 80, which is in use, to be opened. With such a configuration, the spray nozzle 80 may be selectively opened and closed from the outside of the dishwasher 1. Accordingly, the pressure of the wash water is prevented from being distributed, so that the washing power of the dishwasher 1 is increased.

In the embodiment shown in FIG. 3, the spray nozzle 80 has been illustrated as being rotated, but the connection pipe 70 coupled to the spray nozzle 80 may be provided to be rotatable. That is, the spray nozzle 80 and the connection pipe 70 may be provided to rotate relative to each other.

Figure 4:
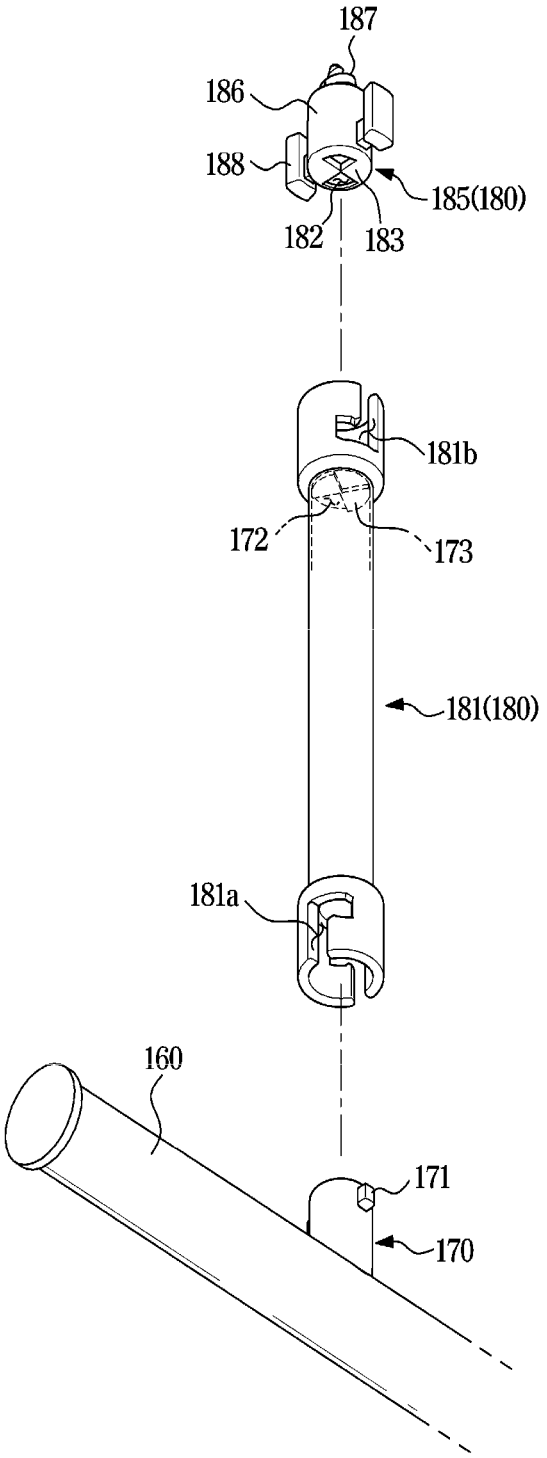
FIG. 4 is a bottom perspective view illustrating a sub-duct, a connection pipe, and a spray nozzle of a dishwasher according to the second embodiment of the disclosure.

FIG. 4 is a bottom perspective view illustrating a sub-duct, a connection pipe, and a spray nozzle of a dishwasher according to the second embodiment of the disclosure.

In the dishwasher according to the second embodiment of the disclosure, unlike the dishwasher according to the first embodiment of the disclosure, whether the wash water is sprayed may be selected through rotation of a nozzle portion 185.

Referring to FIG. 4, the dishwasher may include a sub-duct 160 and a connection pipe 170.

The connection pipe 170 may be connected to the sub-duct 160. The connection pipe 170 may be formed to extend upward from the sub-duct 160. The connection pipe 170 may be integrally formed with the sub-duct 160. However, the implementation of the connection pipe 170 is not limited thereto and the connection pipe 170 may be provided as a separate component. The connection pipe 170 may be provided in at least one unit thereof.

The dishwasher may include a spray nozzle 180 coupled to the connection pipe 170. In detail, the spray nozzle 180 may be provided to be rotatable with respect to the connection pipe 170. The spray nozzle 180 may be provided in at least one unit thereof corresponding in number of the connection pipes 170.

The connection pipe 170 may include a first protrusion 171 protruding outward. The first protrusion 171 may be accommodated and fixed in a first groove portion 181*a* of the spray nozzle 180 to be described below. Such a configuration allows the coupling between the connection pipe 170 and the spray nozzle 180 to be firmly maintained.

The spray nozzle 180 may include a guide pipe 181 and a nozzle portion 185. The guide pipe 181 may be detachably coupled to the connection pipe 170. In addition, the nozzle portion 185 may be detachably coupled to the guide pipe 181. In detail, the connection pipe 170 may be coupled to one side of the guide pipe 181 and the nozzle portion 185 may be coupled to the other side of the guide pipe 181.

The guide pipe 181 may include a first groove portion 181*a* and a second groove portion 181*b*.

The first groove portion 181*a* of the guide pipe 181 may be formed at the one side of the guide pipe 181. Therefore, the first protrusion 171 of the connection pipe 170 may be accommodated and fixed in the first groove portion 181*a*.

The first groove portion 181*a* may be formed as a cut continuously formed along the rotation direction and the rotation axis direction of the spray nozzle 180 so as to receive the first protrusion 171 to thereby be detachably coupled to the connection pipe 170.

The first groove portion 181*a* may be provided to be approximately "1" shaped. In addition, a locking projection may be formed in the first groove portion 181*a* to interfere with the rotation of the first protrusion 171. The locking protrusion may be formed to extend upward. With such a configuration, arbitrary rotation of the first protrusion 171 may be prevented.

With such a configuration, the connection pipe 170 may be coupled to the one side of the guide pipe 181. In addition, the second groove portion 181*b* of the guide pipe 181 may be formed at the other side of the guide pipe 181. A second protrusion 188 of the nozzle portion 185 to be described below may be accommodated and fixed in the second groove portion 181*b* of the guide pipe 181.

The second groove portion 181*b* may be formed as a cut continuously formed along the rotational direction and the rotational axis direction of the spray nozzle 180 so as to receive the second protrusion 188 to thereby be detachably coupled to the connection pipe 170. The second groove portion 181*b* may be provided to be approximately "¬" shaped.

Therefore, the guide pipe 181 may be coupled to the connection pipe 170 to guide the flow of the wash water. In addition, the nozzle portion 185 may be coupled to the guide pipe 181 to spray the wash water into the washing tub. The wash water may flow through the sub-duct 160, the connection pipe 170, the guide pipe 181, and the nozzle portion 185. That is, the sub-duct 160, the connection pipe 170, the guide pipe 181, and the nozzle portion 185 may form a flow path through which wash water flows.

The nozzle portion 185 may include a body 186 and a spray guide portion 187. The body 186 may be fitted to the inner surface of the guide pipe 181. The spray guide portion 187 may be formed to extend upward in a spiral shape from the body 186. With such a configuration, the wash water is sprayed in a spiral manner so that the washing power is increased.

In addition, the body 186 may include a second protrusion 188 protruding outward. The second protrusion 188 may be accommodated and fixed in the second groove portion 181*b* of the guide pipe 181.

The second protrusion 188 of the body 186 may protrude radially outside of the guide pipe 181. Such a configuration may allow access to the second protrusion 188 from the outside. Accordingly, the user may grip the second protrusion 188 to separate or install the guide pipe 181 and the nozzle portion 185.

In addition, the guide pipe 181 may include a first baffle 173 and a first opening portion 172.

The first baffle 173 of the guide pipe 181 may be provided to interfere with the flow of wash water in the connection pipe 170. In other words, the first baffle 173 may be provided to block a part of the flow path. The first baffle 173 may be provided substantially perpendicular to the flow direction of the wash water. In the embodiment shown in FIG. 4, the first baffle 173 is illustrated as a pair of first baffles facing each other. However, the disclosure is not limited thereto, and the first baffle 173 may be provided as one or a pair of units thereof or more.

The first opening portion 172 of the guide pipe 181 may be provided to allow wash water to pass through a side of the first baffle 173. The first opening portion 172 may be formed next to the first baffle 173 in the rotation direction of the spray nozzle 180. The first opening portion 172 may be provided to be open. Details of the flow of the wash water through the first baffle 173 and the first opening portion 172 will be described below.

The nozzle portion 185 may include a second baffle 183 and a second opening portion 182.

In detail, the nozzle portion 185 may include the second baffle 183 provided to come in contact with at least a portion of the first baffle 173 of the connection pipe 170. In detail, the second baffle 183 may be formed on the lower surface of the body 186 of the nozzle portion 185.

The second baffle 183 of the nozzle portion 185 may be provided to interfere with the flow of the wash water in the spray nozzle 180. In other words, the second baffle 183 may be provided to block a part of the flow path. The second baffle 183 may be provided substantially perpendicular to the flow direction of the wash water. In the embodiment shown in FIG. 4, the second baffle 183 is illustrated as a pair of second baffles facing each other. However, the disclosure is not limited thereto, and the second baffle 183 may be provided as one unit, or a pair or more units thereof.

The second baffle 183 may be provided in a shape corresponding to the first opening portion 172 of the guide pipe 181. However, the disclosure is not limited thereto, and the second baffle 183 may be provided to have an area larger than that of the first opening portion 172 without limitation as long as it can close the first opening portion 172.

The second opening portion 182 of the nozzle portion 185 may be provided to allow the wash water to pass through a side of the second baffle 183. The second opening portion 182 may be formed next to the second baffle 183 in the rotation direction of the nozzle portion 185. The second opening portion 182 may be provided to be open.

Hereinafter, a process of spray of wash water being determined through rotation of the nozzle portion 185 will be described.

The nozzle portion 185 may be coupled to the connection pipe 170 to be rotatable between the first position in which the guide pipe 181 is open and the second position in which the guide pipe 181 is closed.

In detail, the first position is a position in which the second baffle 183 of the nozzle portion 185 comes in contact with the upper surface of the first baffle 173 of the connection pipe 170. Having the second baffle 183 come in contact with the upper surface of the first baffle 173 represents that the second opening portion 182 and the first opening portion 172 communicate with each other. With such a configuration, the wash water may flow through the first opening portion 172 and the second opening portion 182. As a result, the wash water may flow through the connection pipe 170 to the nozzle portion 185. That is, the wash water flowing through the nozzle portion 185 may be sprayed into the washing tub.

The second position is a position in which the second baffle 183 of the nozzle portion 185 blocks the first opening portion 172 of the guide pipe 181. In other words, the second position is a position in which the first baffle 173 of the guide pipe 181 blocks the second opening portion 182 of the nozzle portion 185. In the second position, the second baffle 183 is provided to cover the first opening portion 172, that is, the second position is a position to block a flow path through which the wash water flows. With such a configuration, the wash water may not flow through the first opening portion 172 and the second opening portion 182. Accordingly, the flow path through which the wash water flows may be closed. The wash water may not be moved from the guide pipe 181 to the nozzle portion 185 without being sprayed into the washing tub 11.

The user may rotate the nozzle portion 185 between the first position and the second position. Since the spray nozzle 180 may be provided in at least one unit thereof corresponding in number to the connection pipes 170, the user may allow the spray nozzle 180, which is not in use, to be locked and only the spray nozzle 180, which is in use, to be opened. With such a configuration, the spray nozzle 180 may be selectively opened and closed from the outside of the dishwasher 1. Accordingly, the pressure of the wash water is prevented from being distributed, so that the washing power of the dishwasher 1 is increased.

In the embodiment shown in FIG. 4, the nozzle portion 185 has been illustrated as being rotated, but the guide pipe 181 coupled to the nozzle portion 185 may be provided to be rotatable. That is, the nozzle portion 185 and the guide pipe 181 may be provided to rotate relative to each other.

FIGS. 1 and 2 illustrate the sub-duct 60, the connection pipe 70, and the spray nozzle 80 according to the first embodiment of the disclosure, but the disclosure is not limited thereto, and the sub-duct 160, the connection pipe 170, and the spray nozzle 180 may also be applied to the dishwasher shown in FIGS. 1 and 2.

Figure 5:
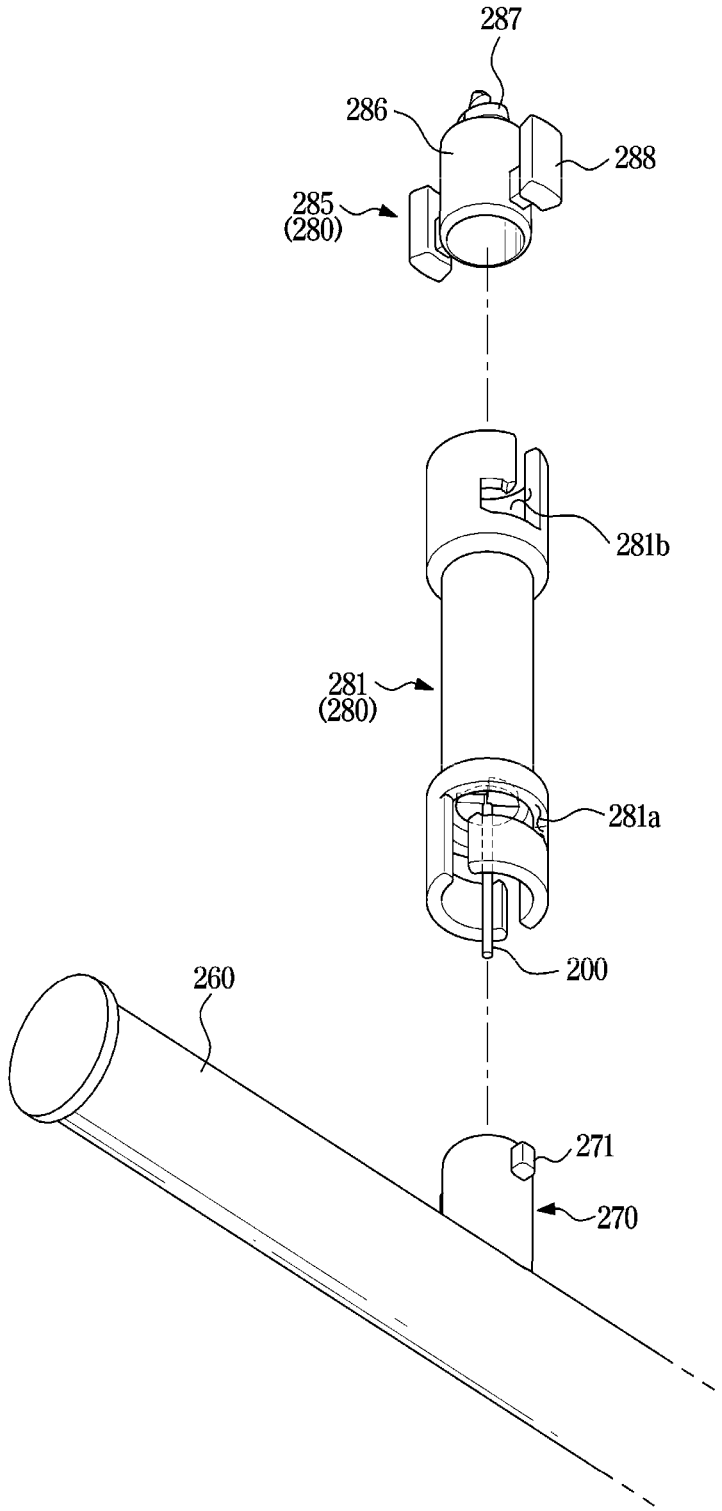
FIG. 5 is a bottom perspective view illustrating a sub-duct, a connection pipe, a spray nozzle, and a rod of a dishwasher according to the third embodiment of the disclosure.
Figure 6:
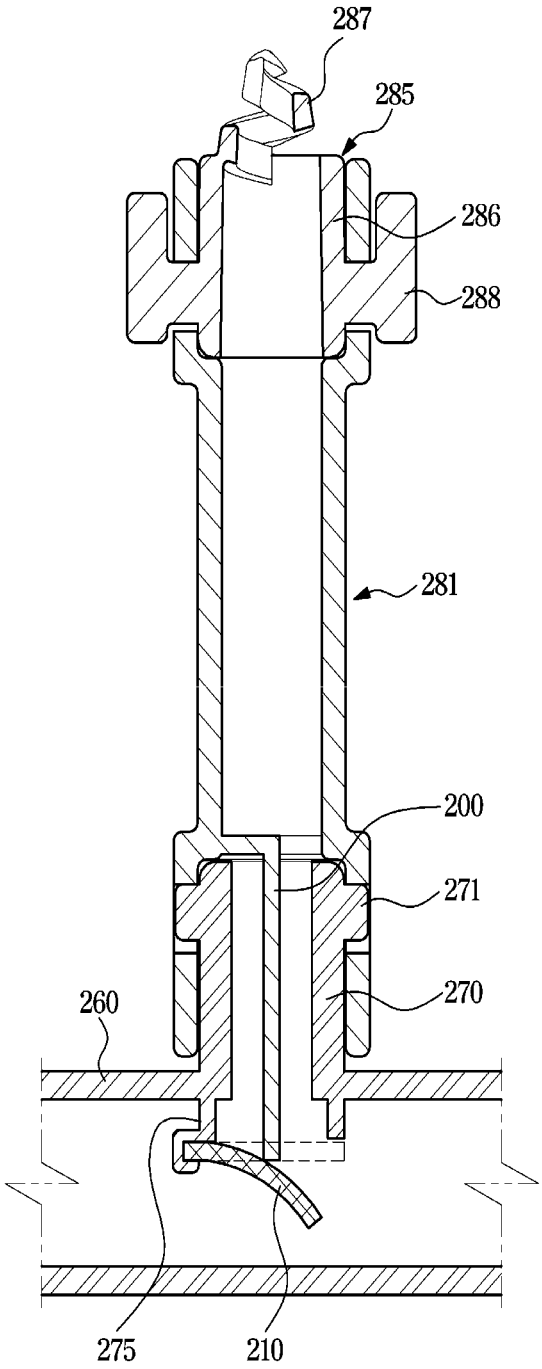
FIG. 6 is a view showing a cross section taken from FIG. 5.

FIG. 5 is a bottom perspective view illustrating a sub-duct, a connection pipe, a spray nozzle, and a rod of a dishwasher according to the third embodiment of the disclosure. FIG. 6 is a view showing a cross section taken from FIG. 5.

Referring to FIGS. 5 and 6, the dishwasher may include a sub-duct 260 and a connection pipe 270.

The connection pipe 270 may be connected to the sub-duct 260. The connection pipe 270 may be formed to extend upward from the sub-duct 260. The connection pipe 270 may be integrally formed with the sub-duct 260. However, the disclosure is not limited thereto and the connection pipe 270 may be provided as a separate component. The connection pipe 270 may be provided in at least one unit thereof.

The dishwasher may include a spray nozzle 280 that is detachably coupled to the connection pipe 270. In detail, the spray nozzle 280 may be provided to be mounted on and detached from the connection pipe 270. The spray nozzle 280 may be provided in at least one unit thereof.

The connection pipe 270 may include a first protrusion 271 protruding outward. The first protrusion 271 may be accommodated and fixed in a first groove portion 281*a* of the spray nozzle 280 to be described below. With such a configuration, the coupling of the connection pipe 270 and the spray nozzle 280 may be firmly maintained.

The spray nozzle 280 may include a guide pipe 281 and a nozzle portion 285. The guide pipe 281 may be coupled to the connection pipe 270. In addition, the nozzle portion 285 may be coupled to the guide pipe 281. In detail, the connection pipe 270 may be coupled to one side of the guide pipe 281, and the nozzle portion 285 may be coupled to the other side of the guide pipe 281.

The guide pipe 281 may include a first groove portion 281*a* and a second groove portion 281*b*. The first groove portion 281*a* of the guide pipe 281 may be formed at the one side of the guide pipe 281. Accordingly, the first protrusion 271 of the connection pipe 270 may be accommodated and fixed in the first groove portion 281*a*.

The first groove portion 281*a* may be formed as a cut continuously formed along the rotational direction and the rotational axis direction of the spray nozzle 280 so as to receive the first protrusion 271 to thereby be detachably coupled with the connection pipe 270.

The first groove portion 281*a* may be provided to be approximately "¬" shaped. In addition, a locking protrusion may be formed in the first groove portion 281*a* to interfere with rotation of the first protrusion 271. The locking protrusion may be formed to extend upward. Accordingly, arbitrary rotation of the first protrusion 271 may be prevented.

With such a configuration, the connection pipe 270 may be coupled to the one side of the guide pipe 281. In addition, the second groove portion 281*b* of the guide pipe 281 may be formed at the other side of the guide pipe 281. A second protrusion 288 of the nozzle portion 285 to be described below may be accommodated and fixed in the second groove portion 281*b* of the guide pipe 281.

The second groove portion 281*b* may be formed as a cut continuously formed along the rotational direction and the rotational axis direction of the spray nozzle 280 so as to receive the second protrusion 288 to thereby be detachably coupled to the connection pipe 270. The second groove portion 281*b* may be provided to be approximately "¬" shaped.

Therefore, the guide pipe 281 may be coupled to the connection pipe 270 to guide the flow of the wash water.

In addition, the nozzle portion 285 may be coupled to the guide pipe 281 to spray the wash water into the washing tub. Therefore, the wash water may flow through the sub-duct 260, the connection pipe 270, the guide pipe 281, and the nozzle portion 285. That is, the sub-duct 260, the connection pipe 270, the guide pipe 281, and the nozzle portion 285 may form a flow path through which wash water flows.

The nozzle portion 285 may include a body 286 and a spray guide portion 287. The body 286 may be fitted to the inner surface of the guide pipe 281. The spray guide portion 287 may be formed to extend upward in a spiral form from the body 286. With such a configuration, the wash water is sprayed in a spiral manner to increase the washing power.

In addition, the body 286 may include the second protrusion 288 protruding outward. The second protrusion 288 may be accommodated and fixed in the second groove portion 281*b* of the guide pipe 281.

The second protrusion 288 of the body 286 may protrude radially outside of the guide pipe 281. Such a configuration may allow access to the second protrusion 288 from the outside. Accordingly, the user may grip the second protrusion 288 to separate or install the guide pipe 281 and the nozzle portion 285.

The dishwasher according to the embodiment shown in FIGS. 5 and 6 may include a valve member 210 provided between the sub-duct 260 and the connection pipe 270. In detail, the valve member 210 may be provided to close the flow path between the sub-duct 260 and the connection pipe 270. The valve member 210 may be formed in a direction substantially perpendicular to the flow direction of the wash water. However, the shape of the valve member 210 is not limited thereto.

The dishwasher may include a support portion 275 provided to support the valve member 210. In detail, the support portion 275 may be provided to support one side of the valve member 210. The support portion 275 may be formed to extend from the inner surface of the sub-duct 260.

In addition, the spray nozzle 280 may include a rod 200.

In detail, the rod 200 may be formed inside the guide pipe 281 of the spray nozzle 280. The rod 200 may be provided to be extended downward in the guide pipe 281. The rod 200 may be provided to be extended into the connection pipe 270 from the inside of the spray nozzle 280 when the spray nozzle 280 is mounted to the connection pipe 270. In addition, the rod 200 may be formed to be extended in a length great enough to pressing the valve member 210.

As such, the valve member 210 may be provided to close the flow path, but in response to be pressed by the rod 200 when the spray nozzle 280 is mounted to the connection pipe 270, open the flow path.

The valve member 210 may be formed of a material having elasticity to open and close the flow path. In detail, the valve member 210 is provided to close the flow path when the spray nozzle 280 is not mounted on the connection pipe 270.

The valve member 210 does not open the flow path in response to a pressure of wash water directed from the sub-duct 260 to the connection pipe 270, but open the flow path in response to a pressure of the rod 200 directed from the connection pipe 270 to the sub-duct 260. Accordingly, the valve member 210 may serve as a check valve.

However, the material and shape of the valve member 210 are not limited thereto. For example, the valve member 210 may be provided as a component having no elasticity and rotated by a rotating shaft, to allow the flow path to be opened by a force exerted by the rod 200 but prevent the flow path from being opened by a pressure of wash water in the sub-duct 260.

Hereinafter, a process of spray of wash water being determined by installation or separation of the spray nozzle 280 will be described.

The spray nozzle 280 may include the rod 200 for pressing the valve member 210.

When the spray nozzle 280 is not mounted on the connection pipe 270, the valve member 210 may be positioned between the sub-duct 260 and the connection pipe 270 without being pressed.

The valve member 210 may be provided to be substantially perpendicular to the flow direction of the wash water between the sub-duct 260 and the connection pipe 270. Accordingly, the valve member 210 may close the flow path through which wash water flows in the sub-duct 260 and the connection pipe 270.

Therefore, when the spray nozzle 280 is not mounted on the connection pipe 270, the wash water may not pass through the connection pipe 270. That is, the wash water may not be sprayed into the washing tub. When the spray nozzle 280 is not mounted on the connection pipe 270, the connection pipe 270 may be closed by the elastic restoring force of the valve member 210 and thus the flow path may be closed.

When the spray nozzle 280 is mounted on the connection pipe 270, the valve member 210 may be positioned between the sub-duct 260 and the connection pipe 270 with a pressure applied thereon.

In detail, the rod 200 formed in the guide pipe 281 of the spray nozzle 280 may press downward the valve member 210. Accordingly, one end of the valve member 210 is supported by the support portion 275 and the other end of the valve member 210 is deformed to open the flow path so that the sub-duct 260 and the connection pipe 270 communicate with each other. That is, when the spray nozzle 280 is mounted on the connection pipe 270, the flow path may be opened. In other words, when the spray nozzle 280 is mounted on the connection pipe 270, the connection pipe 270 may be opened to open the flow path.

The user may mount the spray nozzle 280 to the connection pipe 270 or separate the spray nozzle 280 from the connection pipe 270. By only having the spray nozzle 280 mounted to or separated from the connection pipe 270, the user may select whether to spray wash water through the connection pipe 270, so that the convenience of use may be improved.

In addition, the user may easily determine whether to spray wash water from the outside of the dishwasher, and prevent the pressure of the wash water from being distributed due to the wash water sprayed when the washing is not needed. With such a configuration, the washing power of the dishwasher may be increased.

In the embodiment shown in FIGS. 5 and 6, the rod 200 is illustrated as being formed in the guide pipe 281 of the spray nozzle 280, but the disclosure is not limited thereto, and the rod 200 may be formed in the nozzle portion 285 of the spray nozzle 280 to press the valve member 210.

In addition, FIGS. 1 and 2 illustrate the sub-duct 60, the connection pipe 70, and the spray nozzle 80 according to the first embodiment of the disclosure, but the disclosure is not limited thereto. The sub-duct 260, the connection pipe 270, and the spray nozzle 280 may also be applied to the dishwasher of FIGS. 1 and 2.

Therefore, in the dishwasher according to the embodiment shown in FIGS. 5 and 6, whether to spray wash water through the spray nozzle 280 may be determined depending on whether the spray nozzle 280 is mounted.

Figure 7:
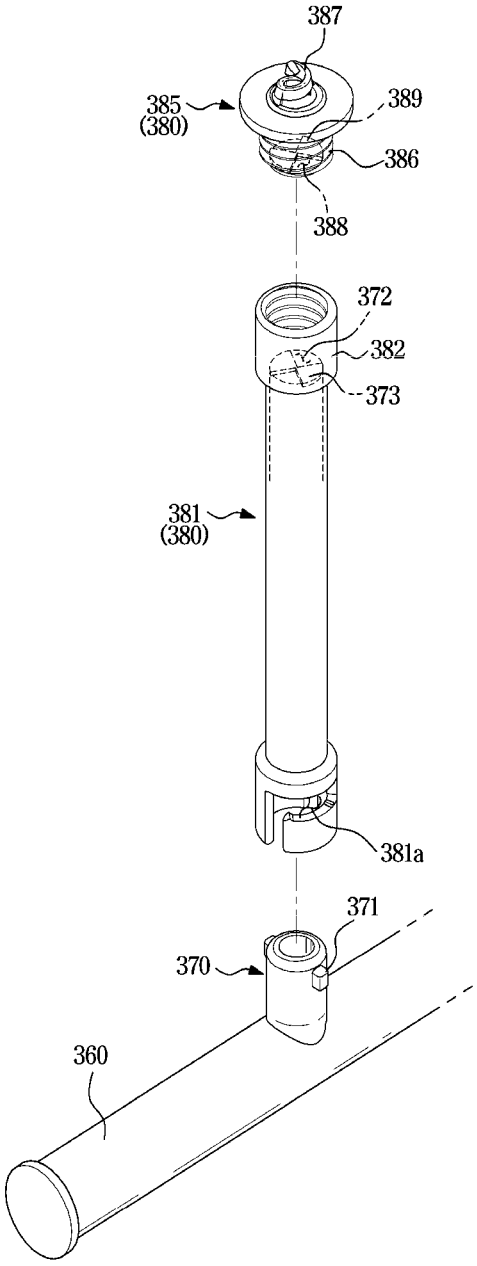
FIG. 7 is a perspective view illustrating a sub-duct, a connection pipe, and a spray nozzle of a dishwasher according to the fourth embodiment of the disclosure.

FIG. 7 is a perspective view illustrating a sub-duct, a connection pipe, and a spray nozzle of a dishwasher according to the fourth embodiment of the disclosure.

The dishwasher according to the fourth exemplary embodiment of the disclosure may select whether to spray wash water through rotation of a nozzle portion 385.

Referring to FIG. 7, the dishwasher may include a sub-duct 360 and a connection pipe 370.

The connection pipe 370 may be connected to the sub-duct 360. The connection pipe 370 may be formed to extend upward from the sub-duct 360. The connection pipe 370 may be integrally formed with the sub-duct 360. However, the disclosure is not limited thereto and the connection pipe 370 may be provided as a separate component. The connection pipe 370 may be provided in at least one unit thereof.

The dishwasher may include a spray nozzle 380 coupled to the connection pipe 370. In detail, the spray nozzle 380 may be provided to be rotatable with respect to the connection pipe 370. The spray nozzle 380 may be provided in at least one unit thereof corresponding in number to the connection pipes 370.

The connection pipe 370 may include a protrusion 371 protruding outward. The protrusion 371 may be accommodated and fixed in a groove portion 381*a* of the spray nozzle 380 to be described below. With such a configuration, the coupling of the connection pipe 370 and the spray nozzle 380 may be firmly maintained.

The spray nozzle 380 may include a guide pipe 381 and a nozzle portion 385. The guide pipe 381 may be detachably coupled to the connection pipe 370. In addition, the nozzle portion 385 may be detachably coupled to the guide pipe 381. In detail, the connection pipe 370 may be coupled to one side of the guide pipe 381 and the nozzle portion 385 may be coupled to the other side of the guide pipe 381.

The guide pipe 381 may include the groove portion 381*a*. The groove portion 381*a* of the guide pipe 381 may be formed at the one side of the guide pipe 381. Accordingly, the protrusion 371 of the connection pipe 370 may be accommodated and fixed in the groove portion 381*a*. With such a configuration, the connection pipe 370 may be coupled to the one side of the guide pipe 381.

The groove portion 381*a* may be formed as a cut continuously formed along the rotational direction and the rotational axis direction of the spray nozzle 380 so as to receive the protrusion 371 to thereby be detachably coupled to the connection pipe 370.

The groove portion 381*a* may be provided to be approximately "¬" shaped. In addition, a locking projection may be formed in the groove portion 381*a* to interfere with rotation of the protrusion 371. The locking protrusion may be formed to extend upward. With such a configuration, arbitrary rotation of the protrusion 371 may be prevented.

In addition, the guide pipe 381 and the nozzle portion 385 may be screwed to each other. The guide pipe 381 may include a coupling portion 382 that is screwed to the nozzle portion 385. Therefore, the nozzle portion 385 may be provided to be rotatable to the guide pipe 381.

The guide pipe 381 may be coupled to the connection pipe 370 to guide the flow of the wash water. In addition, the nozzle portion 385 may be coupled to the guide pipe 381 to spray the wash water into the washing tub. The wash water may flow through the sub-duct 360, the connection pipe 370, the guide pipe 381, and the nozzle portion 385. That is, the sub-duct 360, the connection pipe 370, the guide pipe 381, and the nozzle portion 385 may form a flow path through which wash water flows.

The nozzle portion 385 may include a body 386 and a spray guide portion 387. The body 386 may be screwed to the inner surface of the coupling portion 382 of the guide pipe 381. The spray guide portion 387 may be formed to extend upward in a spiral form from the body 386. With such a configuration, the wash water is sprayed in a spiral manner to increase the washing power.

A thread is formed on the outer surface of the body 386 of the nozzle portion 385 and the inner surface of the coupling portion 382 of the guide pipe 381 so that the nozzle portion 385 and the guide pipe 381 are screwed to each other to enable rotation.

In addition, the guide pipe 381 may include a first baffle 373 and a first opening portion 372.

The first baffle 373 of the guide pipe 381 may be provided to interfere with the flow of wash water in the connection pipe 370. In other words, the first baffle 373 may be provided to block a part of the flow path. The first baffle 373 may be provided substantially perpendicular to the flow direction of the wash water. In the embodiment shown in FIG. 7, the first baffle 373 is illustrated as a pair of first baffles 373 facing each other. However, the disclosure is not limited thereto, and the first baffle 373 may be provided as one unit, or a pair or more units thereof.

The first opening portion 372 of the guide pipe 381 may be provided to allow wash water to pass through a side of the first baffle 373. The first opening portion 372 may be formed next to the first baffle 373 in the rotation direction of the nozzle portion 385. The first opening portion 372 may be provided to be open. Details of the flow of the wash water through the first baffle 373 and the first opening portion 372 will be described below.

The nozzle portion 385 may include a second baffle 389 and a second opening portion 388.

In detail, the spray nozzle 380 may include the second baffle 389 provided to come in contact with the upper surface of the first baffle 373 of the connection pipe 370. In detail, the second baffle 389 may be formed on the lower surface of the body 386 of the nozzle portion 385.

The second baffle 389 of the nozzle portion 385 may be provided to interfere with the flow of wash water in the spray nozzle 380. In other words, the second baffle 389 may be provided to block a part of the flow path. The second baffle 389 may be provided substantially perpendicular to the flow direction of the wash water. In the embodiment shown in FIG. 7, the second baffle 389 is illustrated as a pair of second baffles facing each other. However, the disclosure is not limited thereto, and the second baffle 389 may be provided as one unit, or a pair or more units thereof.

The second baffle 389 may be provided in a shape corresponding to the first opening portion 372 of the guide pipe 381. However, the disclosure is not limited thereto, and the second baffle 389 may be provided to have an area larger than that of the first opening portion 372 without limitation as long as it can close the first opening portion 372.

The second opening portion 388 of the nozzle portion 385 may be provided to allow wash water to pass through a side of the second baffle 389. The second opening portion 388 may be formed next to the second baffle 389 in the rotation direction of the spray nozzle 380. The second opening portion 388 may be provided to be open.

Hereinafter, a process of spray of wash water being determined through rotation of the nozzle portion 385 will be described.

The nozzle portion 385 may be detachably coupled to the guide pipe 381 to be rotatable between the first position in which the guide pipe 381 is open and the second position in which the guide pipe 381 is closed.

In detail, the first position is a position in which the second baffle 389 of the nozzle portion 385 comes in contact with the upper surface of the first baffle 373 of the guide pipe 381. Having the second baffle 389 come in contact with the upper surface of the first baffle 373 represents that the second opening portion 388 and the first opening portion 372 communicate with each other. With such a configuration, the wash water may flow through the first opening portion 372 and the second opening portion 388. As a result, the wash water may flow through the guide pipe 381 to the nozzle portion 385. That is, the wash water flowing through the nozzle portion 385 may be sprayed into the washing tub.

The second position is a position in which the second baffle 389 of the nozzle portion 385 blocks the first opening portion 372 of the guide pipe 381. In other words, the second position is a position in which the first baffle 373 of the connection pipe 370 blocks the second opening portion 388 of the nozzle portion 385. With such a configuration, the wash water may not flow through the first opening portion 372 and the second opening portion 388.

That is, the flow path through which the wash water flows may be closed. The wash water may not be moved from the guide pipe 381 to the nozzle portion 385 without being sprayed into the washing tub.

The user may rotate the spray nozzle 380 between the first position and the second position. Since the spray nozzle 380 may be provided in at least one unit thereof corresponding in number to the connection pipes 370, the user may allow the spray nozzle 380, which is not in use, to be locked and only the spray nozzle 380, which is in use, to be opened through rotation of the nozzle portion 385. With such a configuration, the spray nozzle 80 may be easily and selectively opened and closed from the outside of the dishwasher 1. Accordingly, the pressure of the wash water is prevented from being distributed, thereby increasing the washing power of the dishwasher 1.

In the embodiment shown in FIG. 7, the nozzle portion 385 has been illustrated as being rotated, but the connection pipe 370 coupled to the nozzle portion 385 may be provided to be rotatable. That is, the nozzle portion 385 and the connection pipe 370 may be provided to rotate relative to each other.

In addition, FIGS. 1 and 2 illustrate the sub-duct 60, the connection pipe 70, and the spray nozzle 80 according to the first embodiment of the disclosure, but the disclosure is not limited thereto, and the sub-duct 360, the connection pipe 370, and the spray nozzle 380 according to the fourth embodiment may also be applied to the dishwasher of FIGS. 1 and 2.

Figure 8:
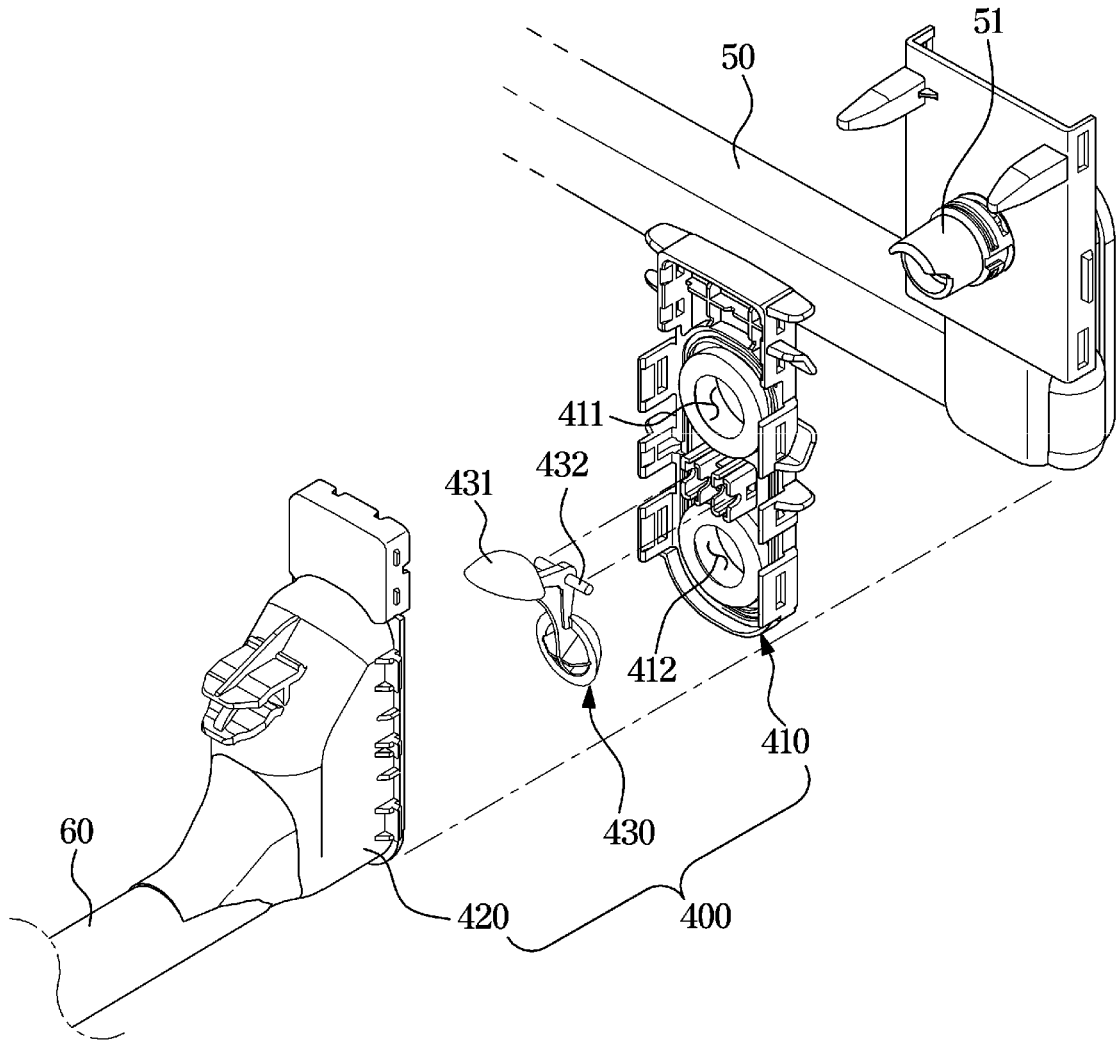
FIG. 8 is an exploded perspective view illustrating a height adjusting device according to an embodiment of the dishwasher according to the disclosure.
Figure 9:
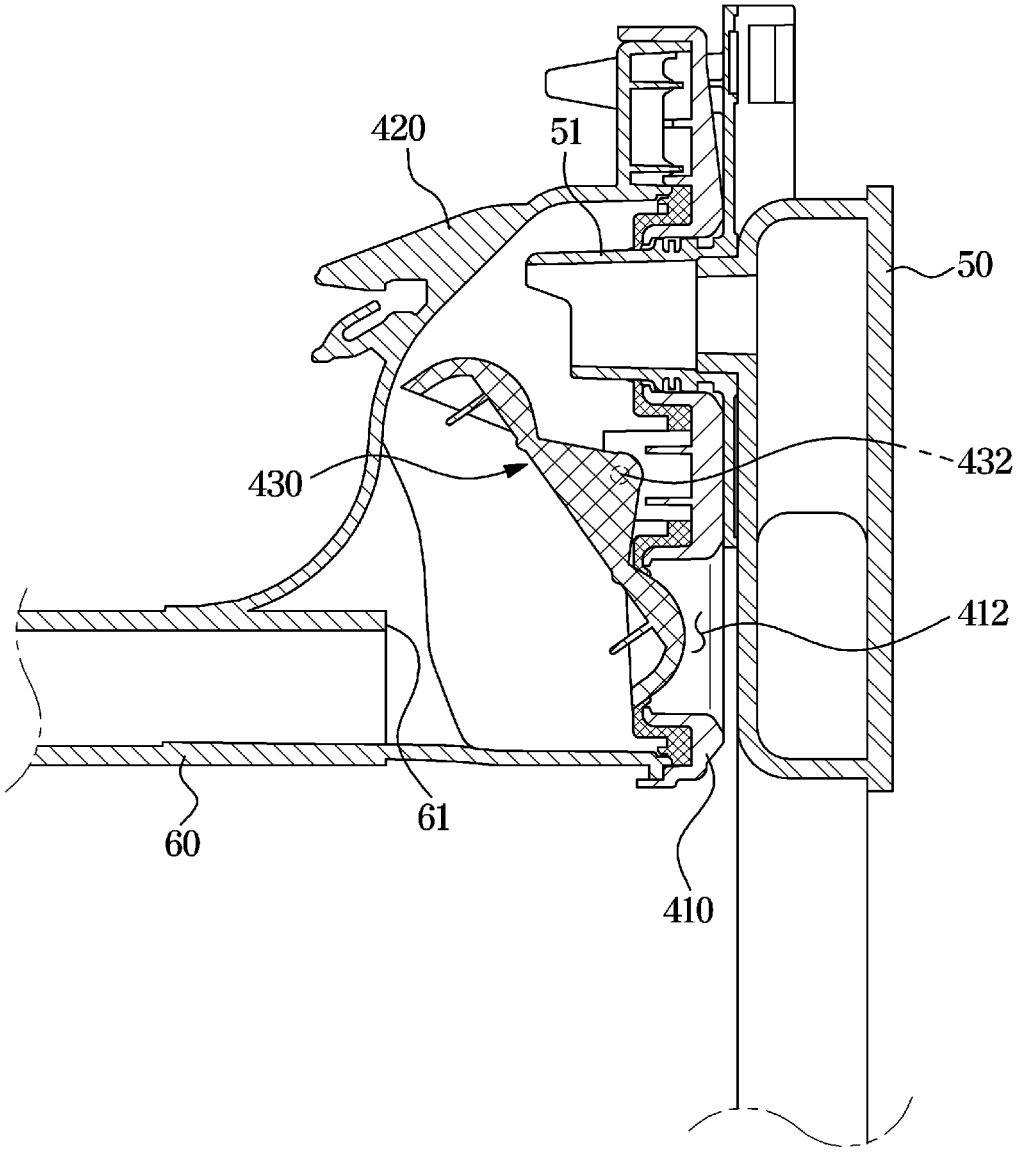
FIG. 9 is a view illustrating a cross-section taken from FIG. 8.

FIG. 8 is an exploded perspective view illustrating a height adjusting device according to an embodiment of the dishwasher according to the disclosure. FIG. 9 is a view illustrating a cross-section taken from FIG. 8.

Referring to FIGS. 8 and 9, the dishwasher may include a height adjusting device 400.

The basket 90 in FIG. 1 may be supported by a guide rack (not shown) to thereby be disposed at different heights inside the washing tub according to the size of the dishware to be accommodated therein. In this case, the height of the sub-duct 60 mounted at one side of the basket 90 in FIG. 1 may also vary. In order to receive the wash water from the duct 50 according to the height of the basket 90 in FIG. 1, the height adjusting device 400 is provided at an inlet portion 61 of the sub-duct 60.

The duct 50 may include an outlet portion 51 to supply the wash water to the sub-duct 60. The wash water may be discharged through the outlet portion 51 of the duct 50 and may be introduced into the sub-duct 60. The outlet portion 51 of the duct 50 may be provided to protrude toward the sub-duct 60. Accordingly, the sub-duct 60 may include the inlet portion 61 to receive the wash water.

The height adjusting device 400 may be coupled between the duct 50 and the sub-duct 60. The height adjusting device 400 may be provided to allow the wash water to flow from the outlet portion 51 of the duct 50 to the inlet portion 61 of the sub-duct 60 according to a change of the height of the basket 90. The height adjusting device 400 may include a first housing 410, a blocking member 430, and a second housing 420.

The first housing 410 may be coupled to a side adjacent to the duct 50. The first housing 410 may include a plurality of openings 411 and 412. The first housing 410 may include a first opening 411 positioned at an upper portion and a second opening 412 positioned at a lower portion. The outlet portion 51 of the duct 50 may be inserted into the first opening 411 or the second opening 412 to supply wash water.

The second housing 420 may be coupled to a side adjacent to the sub-duct 60. In addition, the second housing 420 may be coupled to the first housing 410. The second housing 420 may be coupled to be connected to the inlet portion 61 of the sub-duct 60. The second housing 420 may be integrally formed with the sub-duct 60. The first housing 410 and the second housing 420 may be coupled to each other to form a flow path for supplying the wash water from the duct 50 to the sub-duct 60.

The blocking member 430 may be coupled to the inside of the first housing 410. The blocking member 430 may selectively close the first opening 411 or the second opening 412 of the first housing 410. The blocking member 430 may include a rotation shaft 432 and a cap 431. The cap 431 may be provided symmetrically with respect to the rotation shaft 432 to close the first opening 411 or the second opening 412.

When the outlet portion 51 of the duct 50 is inserted into the first opening 411, the wash water may flow from the outlet portion 51 of the duct 50 to the inlet portion 61 of the sub-duct 60. In this case, the second opening 412 may be closed by the cap 431 of the blocking member 430. The blocking member 430 is configured to be rotatable about the rotation shaft 432, and when wash water is supplied through the first opening 411 and the outlet portion 51 of the duct 50, rotate in a direction to close the second opening 412.

With such a configuration, the wash water may be prevented from leaking through the second opening 412, thereby maintaining a constant washing power of the dishwasher.

When the outlet portion 51 of the duct 50 is inserted into the second opening 412, the wash water may flow from the outlet portion 51 of the duct 50 to the inlet portion 61 of the sub-duct 60. In this case, the first opening 411 may be closed by the cap 431 of the blocking member 430. The blocking member 430 is provided to be rotatable about the rotation shaft 432, and when the wash water is supplied through the second opening 412 and the outlet portion 51 of the duct 50, rotates in a direction to close the first opening 411.

Since the position of the duct 50 is fixed, having the outlet portion 51 of the duct 50 inserted into the second opening 412 represents that the basket 90 in FIG. 1 on which the sub-duct 60 is mounted is placed at a higher position inside the washing tub.

Accordingly, such a configuration of the blocking member 430 may close an opening, into which the outlet portion 51 of the duct 50 is not inserted, among the plurality of openings 411 and 412 of the first housing 410, so that the pressure of wash water in the dishwasher is kept constant. Therefore, the performance of the dishwasher may be ensured together with height adjustment.

Although FIGS. 8 and 9 illustrate the sub-duct 60, which is a component of the dishwasher according to the first embodiment of the disclosure, the disclosure is not limited thereto, and the height adjusting device 400 according to the embodiment shown in FIGS. 8 and 9 may also be applied to dishwashers according to other embodiments of the disclosure.

Figure 10:
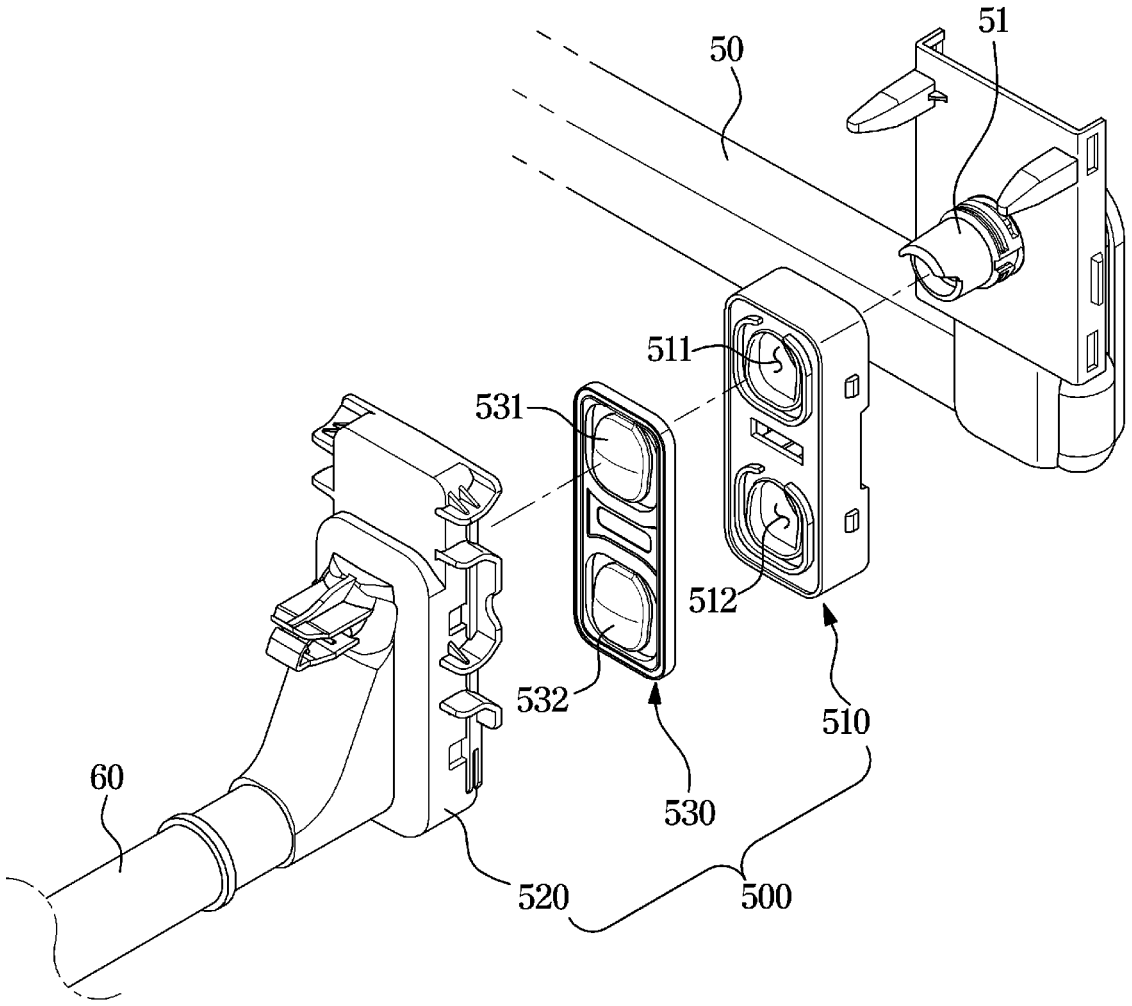
FIG. 10 is an exploded perspective view illustrating a height adjusting device according to another embodiment of the dishwasher of the disclosure.
Figure 11:
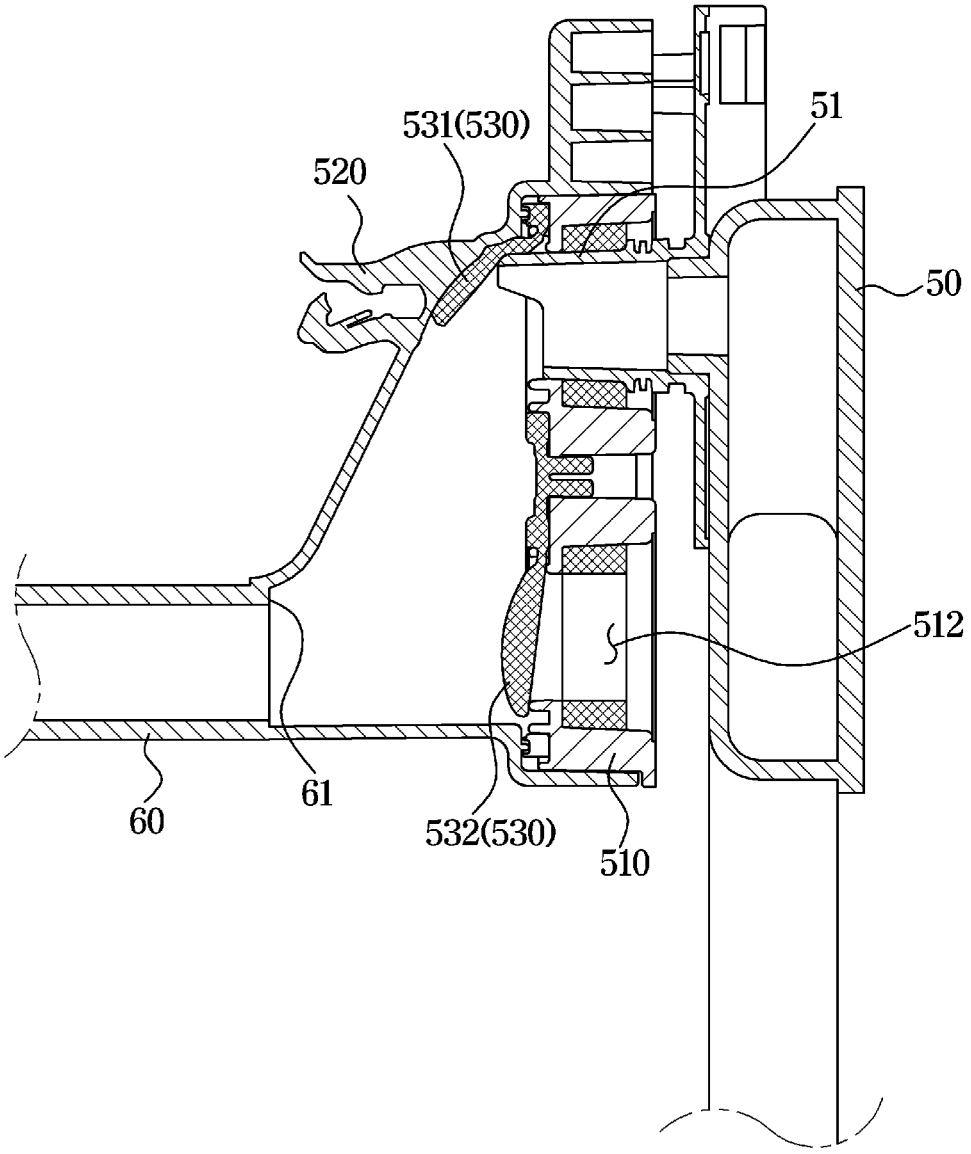
FIG. 11 is a view showing a cross section taken from FIG. 10.

FIG. 10 is an exploded perspective view illustrating a height adjusting device according to another embodiment of the dishwasher of the disclosure. FIG. 11 is a view showing a cross section taken from FIG. 10.

Referring to FIGS. 10 and 11, the dishwasher may include a height adjusting device 500.

The basket 90 in FIG. 1 may be supported by a guide rack (not shown) to thereby be disposed at different heights inside the washing tub according to the size of the dishware to be accommodated therein. In this case, the height of the sub-duct 60 mounted on one side of the basket 90 in FIG. 1 may also vary. In order to receive the wash water from the duct 50 according to the height of the basket 90 in FIG. 1, the height adjusting device 500 may be provided at an inlet portion 61 of the sub-duct 60.

The duct 50 may include an outlet portion 51 to supply the wash water to the sub-duct 60. The wash water may be discharged through the outlet portion 51 of the duct 50 and may be introduced into the sub-duct 60. The outlet portion 51 of the duct 50 may be provided to protrude toward the sub-duct 60. Accordingly, the sub-duct 60 may include the inlet portion 61 to receive the wash water.

The height adjusting device 500 may be coupled between the duct 50 and the sub-duct 60. The height adjusting device 500 may be provided to allow the wash water to flow from the outlet portion 51 of the duct 50 to the inlet portion 61 of the sub-duct 60 according to a change of the height of the basket 90. The height adjusting device 500 may include a first housing 510, a blocking member 530, and a second housing 520.

The first housing 510 may be coupled to a side adjacent to the duct 50. The first housing 510 may include a plurality of openings 511 and 512. The first housing 510 may include a first opening 511 positioned at an upper portion and a second opening 512 positioned at a lower portion. The outlet portion 51 of the duct 50 may be inserted into the first opening 511 or the second opening 512 to supply wash water.

The second housing 520 may be coupled to a side adjacent to the sub-duct 60. In addition, the second housing 520 may be coupled to the first housing 510. The second housing 520 may be coupled to be connected to the inlet portion 61 of the sub-duct 60. The second housing 520 may be integrally formed with the sub-duct 60. The first housing 510 and the second housing 520 may be coupled to each other to form a flow path for supplying the wash water from the duct 50 to the sub-duct 60.

The blocking member 530 may be coupled to the inside of the first housing 510. The blocking member 530 may selectively close the first opening 511 or the second opening 512 of the first housing 410. The blocking member 530 may include a plurality of rubber caps. The plurality of rubber caps may include a first rubber cap 531 provided at an upper portion and a second rubber cap 532 provided at a lower portion. The first rubber cap 531 and the second rubber cap 532 may be provided to close the first opening 511 and the second opening 512, respectively.

When the outlet portion 51 of the duct 50 is inserted into the first opening 511, the wash water may flow from the outlet portion 51 of the duct 50 to the inlet portion 61 of the sub-duct 60. In this case, the second opening 512 may be closed by the second rubber cap 532 of the blocking member 530. The first rubber cap 531 may allow the first opening 511 to be open by a force of the outlet portion 51 of the duct 50 pushing the first rubber cap 531.

The second rubber cap 532 of the blocking member 530 prevents wash water from leaking through the second opening 512, so that the washing power of the dishwasher may be kept constant.

When the outlet portion 51 of the duct 50 is inserted into the second opening 512, the wash water may flow from the outlet portion 51 of the duct 50 to the inlet portion 61 of the sub-duct 60. In this case, the first opening 511 may be closed by the first rubber cap 531 of the blocking member 530. The second rubber cap 532 may allow the second opening 512 to be open by a force of the outlet portion 51 of the duct 50 pushing the second rubber cap 532.

Since the position of the duct 50 is fixed, having the outlet portion 51 of the duct 50 inserted into the second opening 512 represents that the basket 90 in FIG. 1 is placed at a higher position in the washing tub.

With such a configuration of the first rubber cap 531 and the second rubber cap 532 of the blocking member 530, an opening into which the outlet portion 51 of the duct 50 is not inserted among the plurality of openings 511 and 512 may be closed, so that the pressure of the wash water of the dishwasher may be kept constant. Therefore, the performance of the dishwasher may be ensured together with height adjustment.

Although FIGS. 10 and 11 illustrate the sub-duct 60, which is a component of the dishwasher according to the first embodiment of the disclosure, the disclosure is not limited thereto, and the height adjusting device 500 according to the embodiment shown in FIGS. 10 and 11 may also be applied to dishwashers according to other embodiments of the disclosure.

Figure 12:
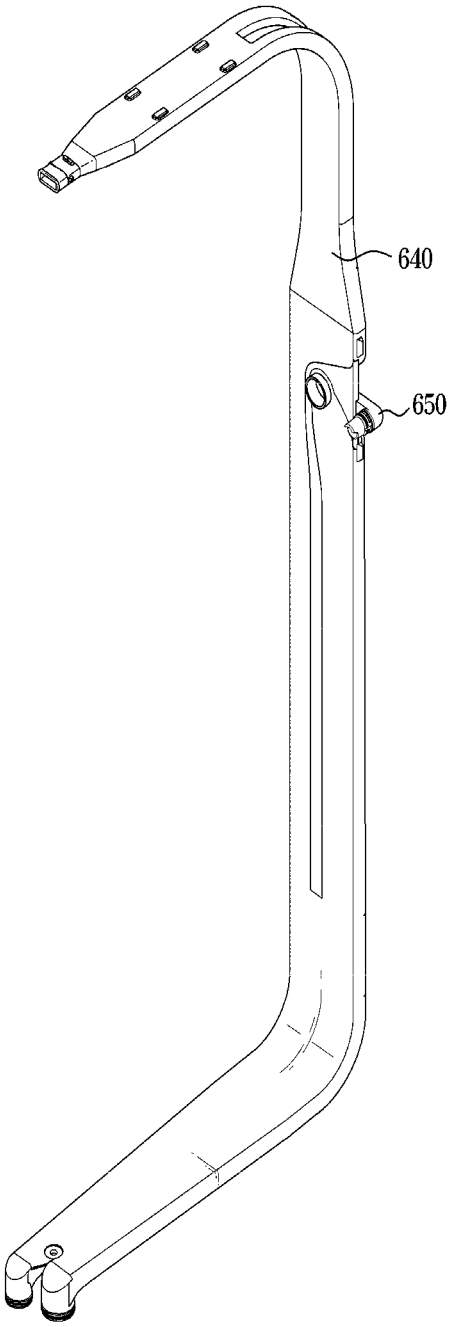
FIG. 12 is a perspective view illustrating a main duct and a duct according to another embodiment of the dishwasher of the disclosure.

FIG. 12 is a perspective view illustrating a main duct and a duct according to another embodiment of the dishwasher of the disclosure.

The following description will be made on some features that are different from those of the main duct 90 and the duct 50 shown in FIG. 1. Components other than a main duct 640 and a duct 650 may be applied in the same manner to the embodiment shown in FIG. 12. The same reference numerals are assigned to the same configurations as those in the above-described embodiments.

Referring to FIG. 12, the dishwasher may include the main duct 640 and the duct 650. Unlike the duct 50 shown in FIG. 1, the duct 650 and the main duct 640 may not be provided separately from each other without being individually receiving wash water from the sump unit 20.

That is, the duct 650 may be formed integrally with the main duct 640 and branched from the main duct 640.

With such a configuration, the wash water may be supplied to each of the spray unit 30 and the sub-duct 60 in a simple configuration compared to FIG. 1.

The length of the duct 650 is not limited to that shown in FIG. 12 and may be formed longer depending on the position of the sub-duct 60 or may be formed in the opposite direction.

As is apparent from the above, a flow path through which wash water flows is opened and closed through rotation of a spray nozzle, so that whether to use the nozzle can be easily selected.

Wash water is prevented from being sprayed through a spray nozzle that is not in use, so that the pressure of wash water can be prevented from being distributed, and thus the washing power can be concentrated.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A dishwasher comprising:

a washing tub;

a basket provided in the washing tub to accommodate dishware;

a duct provided in the washing tub to be supplied with wash water;

a sub-duct mounted on the basket to guide the wash water;

a connection pipe including a flow path connected to the sub-duct; and a spray nozzle coupled to the connection pipe to be rotatable from a first position where the connection pipe is open and a second position where the connection pipe is closed, and wherein the spray nozzle includes a guide pipe coupled to the connection pipe to guide a flow of the wash water and extending toward an upper portion of the washing tub.

2. The dishwasher of claim 1, wherein the connection pipe includes: a baffle provided to block a part of the flow path of the connection pipe; and an opening portion formed next to the baffle in a rotation direction of the spray nozzle.

3. The dishwasher of claim 2, wherein:

the baffle and the opening portion form a first baffle and a first opening portion, respectively, and the spray nozzle includes a second baffle provided to cover the opening portion of the connection pipe when the spray nozzle is in the second position and a second opening portion formed next to the second baffle in the rotation direction of the spray nozzle.

4. The dishwasher of claim 3, wherein when the spray nozzle is rotated from the second position to the first position to cause the second baffle to come in contact with an upper surface of the first baffle, wash water is sprayed to an inside of the washing tub through the first opening portion and the second opening portion.

5. The dishwasher of claim 4, wherein when the spray nozzle is rotated from the first position to the second position to cause the second baffle to cover the first opening portion, the wash water is prevented from being sprayed into the washing tub.

6. The dishwasher of claim 1, wherein:

the connection pipe includes a first protrusion protruding outward, and the spray nozzle includes a first groove portion formed as a cut continuously formed along a rotation direction and a rotation axis direction of the spray nozzle to accommodate the first protrusion to thereby be detachably coupled to the connection pipe.

7. The dishwasher of claim 6, wherein the first groove portion is formed with a locking protrusion to interfere with rotation of the first protrusion.

8. The dishwasher of claim 1, wherein:

the spray nozzle includes the guide pipe to support dishware accommodated in the basket; and a nozzle portion detachably coupled to the guide pipe to spray the wash water into the washing tub.

9. The dishwasher of claim 8, wherein the nozzle portion includes:

a body fitted to an inner surface of the guide pipe; and a spray guide portion configured to guide a spray direction such that the wash water is sprayed in a spiral shape.

10. The dishwasher of claim 9, wherein:

the body of the nozzle portion includes a second protrusion protruding outward, and the guide pipe includes a second groove portion formed as a cut continuously formed along a rotation direction and a rotation axis direction of the spray nozzle to accommodate the second protrusion.

11. The dishwasher of claim 10, wherein the second protrusion of the nozzle portion protrudes radially outside of the guide pipe to be accessible from an outside.

12. The dishwasher of claim 1, further comprising:

a spray unit mounted at a lower portion of the basket and configured to spray the wash water into the washing tub; and a main duct configured to supply the wash water to the spray unit.

13. The dishwasher of claim 12, wherein the duct is integrally formed with the main duct and branched from the main duct.

14. The dishwasher of claim 1, further comprising a height adjusting device coupled to the duct and the sub-duct such that the wash water flows from an outlet portion of the duct to an inlet portion of the sub-duct based on a change in a height of the basket.

15. The dishwasher of claim 14, wherein the height adjusting device includes:

a first housing including a plurality of openings into which the outlet portion of the duct is inserted;

a second housing coupled to the first housing and connected to the inlet portion of the sub-duct; and a blocking member coupled to an inside of the first housing and provided to selectively close one of the plurality of openings according to the insertion of the outlet portion of the duct.

16. A dishwasher comprising:

a washing tub;

a basket provided in the washing tub to accommodate dishware;

a duct provided in the washing tub to be supplied with wash water;

a sub-duct mounted on the basket to guide the wash water;

a connection pipe communicating with the sub-duct to form a flow path;

a spray nozzle detachably coupled to the connection pipe;

a valve member configured to close the flow path provided between the sub-duct and the connection pipe; and a rod provided in the spray nozzle and configured to press the valve member to open the flow path when the spray nozzle is mounted to the connection pipe.

17. The dishwasher of claim 16, wherein the valve member includes a material having elasticity, and configured to cause the flow path to be closed by an elastic restoring force without the spray nozzle being mounted on the connection pipe.

18. The dishwasher of claim 16, wherein the rod is configured to be extended into the connection pipe from an inside of the spray nozzle to cause the valve member to be pressed when the spray nozzle is mounted to the connection pipe.

19. A dishwasher comprising:

a washing tub;

a basket provided to accommodate dishware;

a duct provided in the washing tub to be supplied with wash water;

a sub-duct mounted on the basket to guide the wash water;

a connection pipe formed to extend upward from the sub-duct; and a spray nozzle provided to be movable relative to the connection pipe, the spray nozzle configured to open and close the connection pipe based on a change of a position of the spray nozzle, and wherein the spray nozzle includes a guide pipe coupled to the connection pipe to guide a flow of the wash water and extending toward an upper portion of the washing tub.

20. The dishwasher of claim 19, further comprising:

a height adjusting device configured to connect the duct to the sub-duct based on a height of the basket, wherein the height adjusting device includes:

a first housing including a plurality of openings into which an outlet portion of the duct is inserted;

a second housing coupled to the first housing and connected to an inlet portion of the sub-duct; and a blocking member coupled to an inside of the first housing and configured to selectively close one of the plurality of openings according to the insertion of the outlet portion of the duct.

* * * * *